US007137860B2

(12) United States Patent
Ahn et al.

(10) Patent No.: US 7,137,860 B2
(45) Date of Patent: Nov. 21, 2006

(54) METHOD FOR FABRICATING A FIELD EMISSION DISPLAY WITH CARBON-BASED EMITTER

(75) Inventors: Sang-Hyuck Ahn, Seoul (KR); Sang-Jo Lee, Suwon (KR)

(73) Assignee: Samsung SDI Co., Ltd., Suwon-Si (KR)

( * ) Notice: Subject to any disclaimer, the term of this patent is extended or adjusted under 35 U.S.C. 154(b) by 7 days.

(21) Appl. No.: 10/087,741

(22) Filed: Mar. 5, 2002

(65) Prior Publication Data

US 2002/0197928 A1 Dec. 26, 2002

(30) Foreign Application Priority Data

Jun. 22, 2001 (KR) ..... 2001-0035722

(51) Int. Cl.
*H01J 9/04* (2006.01)

(52) U.S. Cl. ..... 445/50; 445/24

(58) Field of Classification Search ..... 445/24, 445/25, 48–51; 313/309, 310, 495
See application file for complete search history.

(56) References Cited

U.S. PATENT DOCUMENTS 3,789,471 A 2/1974 Spindt et al.
5,848,925 A * 12/1998 Howard et al. ..... 445/24
6,013,238 A * 1/2000 Murata et al. ..... 423/598
6,062,931 A 5/2000 Chuang et al.
6,097,138 A 8/2000 Nakamoto
6,097,139 A * 8/2000 Tuck et al. ..... 313/310
6,250,984 B1 * 6/2001 Jin et al. ..... 445/51
6,283,812 B1 * 9/2001 Jin et al. ..... 445/24
6,436,221 B1 * 8/2002 Chang et al. ..... 156/247
6,534,723 B1 * 3/2003 Asai et al. ..... 174/255
6,626,720 B1 * 9/2003 Howard et al. ..... 445/24
6,645,402 B1 * 11/2003 Kurokawa et al. ..... 252/502
6,682,383 B1 * 1/2004 Cho et al. ..... 445/50
2004/0224081 A1 * 11/2004 Sheu et al. ..... 427/58
2006/0022578 A1 * 2/2006 Ryu ..... 313/497

FOREIGN PATENT DOCUMENTS

JP 2001-035360 2/2001

* cited by examiner

*Primary Examiner*—Karabi Guharay
*Assistant Examiner*—Dalei Dong
(74) *Attorney, Agent, or Firm*—H.C. Park & Associates, PLC

(57) ABSTRACT

In a method for fabricating a field emission device, a cathode electrode is first formed on a substrate and an emitter having a carbon-based material is formed on the cathode electrode. After an emitter surface treatment agent is deposited on the substrate to cover the emitter, the emitter surface treatment agent and hardened and removed from the substrate such that the carbon-based material contained in the emitter can be exposed out of a surface of the emitter.

13 Claims, 6 Drawing Sheets

METHOD FOR FABRICATING A FIELD EMISSION DISPLAY WITH CARBON-BASED EMITTER

BACKGROUND OF THE INVENTION

1. Field of the Invention

The present invention relates to a method for fabricating a field emission display with a carbon-based emitter.

2. Description of the Related Art

A quality of a field emission display using a cold-cathode as an electron emission source depends on a characteristic of an emitter which is an electron emission layer.

Conventionally, such an emitter is formed in a tip-shaped spindt type made of Mo-based metal. Such a tip-shape spindt type emitter is disclosed in the U.S. Pat. No. 3,789,471.

However, to fabricate a field emission display having such a tip-shaped emitter, a series of semiconductor manufacturing processes such as photolithography and etching processes for forming holes for fixing the emitter and a vapor deposition process for depositing Mo to form the metal tip. However, these processes are time-consuming and costly.

Accordingly, techniques for forming a planar emitter have been developed to simplify the manufacturing process while allowing the emitter to emit electrons under a relatively low voltage (10–50V) driving condition.

As a material for forming the planar emitter, well known is a carbon-based material such as graphite, diamond and carbon nanotube. Particularly, the carbon nanotube is expected as the most ideal material for the planar emitter as it effectively emits electrons under a relatively lower driving voltage.

An electric field emission display with such a carbon nanotube emitter is disclosed, for example, in the U.S. Pat. Nos. 6,062,931 and 6,097,138.

In the patents, the carbon nanotube emitter is formed through a PCVD (Plasma Chemical Vapor Deposition) process, a coating process, a printing process and the like.

However, when the emitter is formed using the carbon-based material through a series of processes, the surface property of the planar emitter easily deteriorates, because the carbon-based material has a high bonding energy with other materials used in such processes.

For example, a photolithography process should be performed to form an electrode (gate and focusing electrodes) for emitting electric field on the emitter. A photoresist used for the photolithography process remains on the emitter surface, deteriorating the electric field emission characteristic. Etching solution used for patterning the electrode also deteriorates the emitter performance.

In addition, when the emitter is heat-treated for baking, the carbon contained in the emitter is burned as it reacts with oxygen (see FIG. 4).

As described above, when the emitter is formed of a carbon-based material, a variety of problems are encountered.

SUMMARY OF THE INVENTION

Therefore, the present invention has been made in an effort to solve the above problems.

It is an objective of the present invention to provide a method for fabricating a field emission display, which can prevent the electric field emission characteristic from being deteriorated by compensating for the surface damage of the emitter.

To achieve the above objective, the present invention provides a method for fabricating a field emission display, comprising the steps of forming a cathode electrode on a substrate; forming an emitter having a carbon-based material on the cathode electrode; depositing an emitter surface treatment agent on the substrate to cover the emitter; hardening the emitter surface treatment agent; and removing the hardened emitter surface treatment agent from the substrate such that the carbon-based material contained in the emitter can be exposed out of a surface of the emitter.

Preferably, the step of forming the emitter further comprises the steps of printing a paste having the carbon-based material on the cathode electrode; and heat-treating the printed paste at a temperate lower than a temperature for completely baking the paste. The step of printing the paste is performed through a screen-printing process using a metal mesh screen.

Preferably, the carbon-based material is selected from the group consisting of a carbon nanotube, graphite, and diamond.

Preferably, the step of depositing the emitter surface treatment agent is performed through a spin-coating process, and the step of hardening the emitter surface treatment agent is performed by a heat-treatment process.

Preferably, the emitter surface treatment agent is a polyimide solution.

Preferably, the step of heat-treating the printed paste is performed at the temperature of about 350–430° C. for about 2 minutes.

The heat-treatment process is performed in a state where the substrate deposited with the surface treatment agent is located on a hot plate maintaining a temperature of about 90° C. for about 20 minutes.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION OF THE PREFERRED EMBODIMENTS

A preferred embodiment of the present invention will be described in detail with reference to the accompanying drawings.

Figure 1:
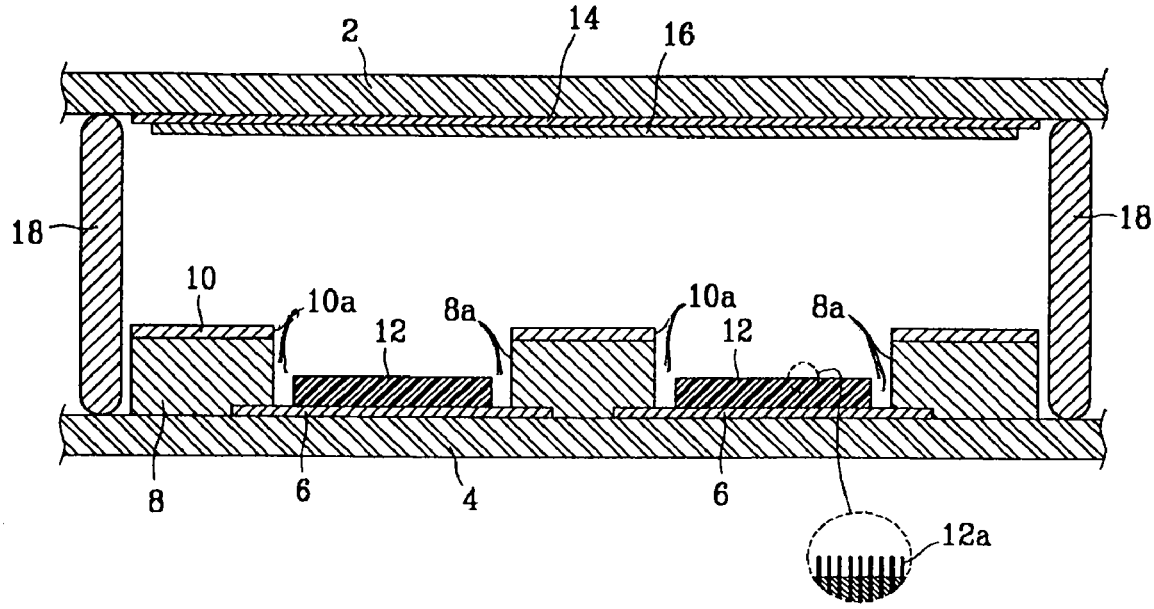
FIG. 1 is a sectional view of a field emission display that can be fabricated by a method according to the present invention.

FIG. 1 shows a field emission display that can be fabricated by a method according to a preferred embodiment of the present invention.

A field emission display comprises front substrate 2 and rear substrate 4 that are disposed to define an inner space therebetween.

A cathode electrode 6 having plural line patterns is disposed on the rear substrate 4, and an insulating layer 8 is formed on the cathode electrode 6 to a certain height. The insulating layer 8 has a plurality of holes 8*a* that expose parts of the line patterns of the cathode electrode 6. A gate electrode 10 having a pluralilty of line patterns intersecting the line patterns of the cathode electrode 10 at right angles is formed on the insulating layer 8 except for a portion where the holes 8*a* are formed. The gate electrode 10 has holes 10*a* corresponding to the holes 8*a*. Emitters 12 are formed to a certain height on the exposed line patterns of the cathode electrode 6 through the holes 8*a* and 10*a*. The height of the emitter 12 is less than that of the insulating layer 8.

The emitters 12 are formed of a carbon-based material such as a carbon nanotube, graphite, diamond and the like and provided with a planar surface. In this embodiment, a plurality of carbon nanotubes are used as a material for forming the emitters 12.

Formed on the front substrate 2 is an anode electrode 14 having a plurality of line patterns, on which a phosphor layer 16 is formed.

The reference numeral 18 indicates spacers that maintain a predetermined cell gap between the front substrate 2 and the rear substrate 4.

A feature of the invention is to provide a method for exactly aligning the nanotubes 12*a* on the surface of the emitter 12 when the emitter 12 is formed of the carbon-based material, thereby compensating for the damage of the emitter surface to prevent the electron emission characteristic from being deteriorated.

FIGS. 2A, 2B, 2C and 2D show steps of such a method for fabricating the field emission display.

First, the plural line patterns of the cathode electrode 6 are formed on the rear substrate 4 through a printing or sputtering process.

Next, the insulating layer 8 and the plural line patterns of the gate electrode 10 are formed on the cathode electrode 6. At this point, the holes 10*a* and 8*a* are also formed.

The insulating layer 8 is formed through a printing or CVD process, the gate electrode 10 is formed through a printing or sputtering process, and the holes 8*a* and 10*a* are formed through a photolithography process.

Next, the emitters 12 arc formed on the plurality of line patterns of the cathode electrode 6. Preferably, the emitters 12 are formed through a screen-printing process using a metal mesh screen. That is, a mesh screen formed of a stainless wire and paste for the emitters are first prepared. Preferably, the paste is composed of carbon nanotube powder, binder, vehicle that is dissolved in a liquid state at a high temperature and solidified by a backing process, and a solvent. Further preferably, as the binder, vehicle and the solvent, used are respectively ethyl cellulose, glass powder and terpineol.

After the paste is printed on the cathode electrode 6 through the mesh screen, it is baked to harden the printed paste, thereby forming the emitters 12.

Preferably, the baking process is performed at a temperature lower than the actual baking temperature of the paste such that less than 50% of the vehicle is solidified. In this embodiment, the baking process is performed at a temperature of 350–430° C. for 2 minutes. For the reference, the actual baking process for completely hardening the paste is performed at a temperature of about 500–600° C. for 10 minutes.

Figure 2A:
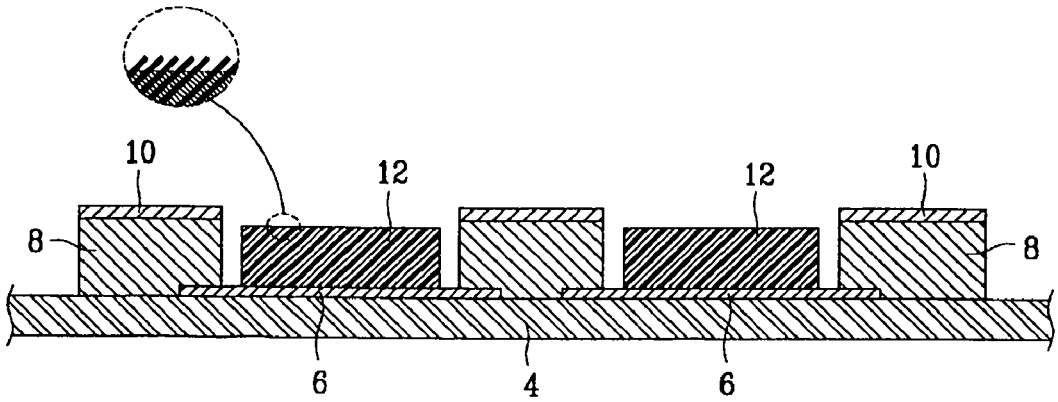
FIGS. 2A, 2B, 2C and 2D are sectional views illustrating a method for fabricating an electric field emission display according to a preferred embodiment of the present invention.

After the emitters 12 are formed through the above-described process as shown in FIG. 2*a*, a process for treating the surface of the emitters 12 is performed. That is, after printing the paste on the cathode electrode, the surfaces of the emitters 12 may be damaged during the following process such as the baking process such that the carbon nanotubes 12*a* are not vertically arranged. Therefore, the surface treatment process is performed to compensate for the damage of the surfaces of the emitters 12.

Figure 2B:
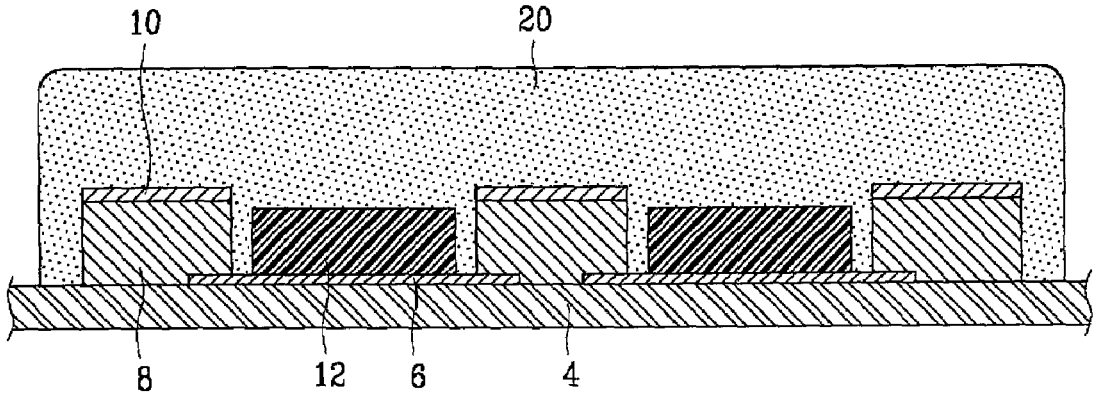

In the surface treatment process, surface treatment agent is deposited on the rear substrate 6 to cover the emitters 12 through, for example, a spin-coating process. The deposited surface treatment agent is hardened through a heat-treatment process to form a treatment film 20 as shown in FIG. 2*b*.

Preferably, as the surface treatment agent, polyimide solution made by dissolving polyimide in N-methyl-2pyrrolidone solvent.

The heat-treatment process for hardening the surface treatment agent is performed in a state where the rear substrate 6 deposited with the surface treatment agent is located on a hot plate maintaining a temperature of about 90° C. for 20 minutes.

Next, the hardened surface treatment agent (treatment film) 20 is removed from the rear substrate 6 and the surfaces of the emitters 12 are activated. That is, a process for exposing the carbon nanotubes 12*a* out of the surfaces of the emitters 12 is performed.

Figure 2C:
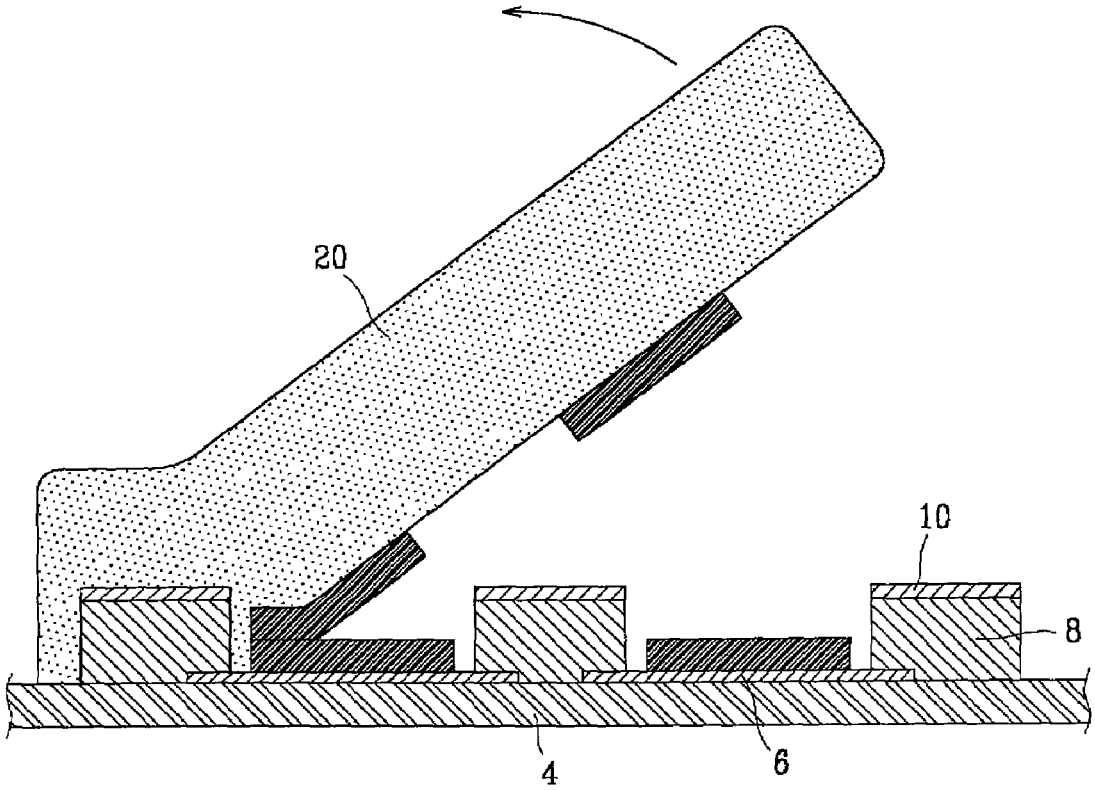
Figure 2D:
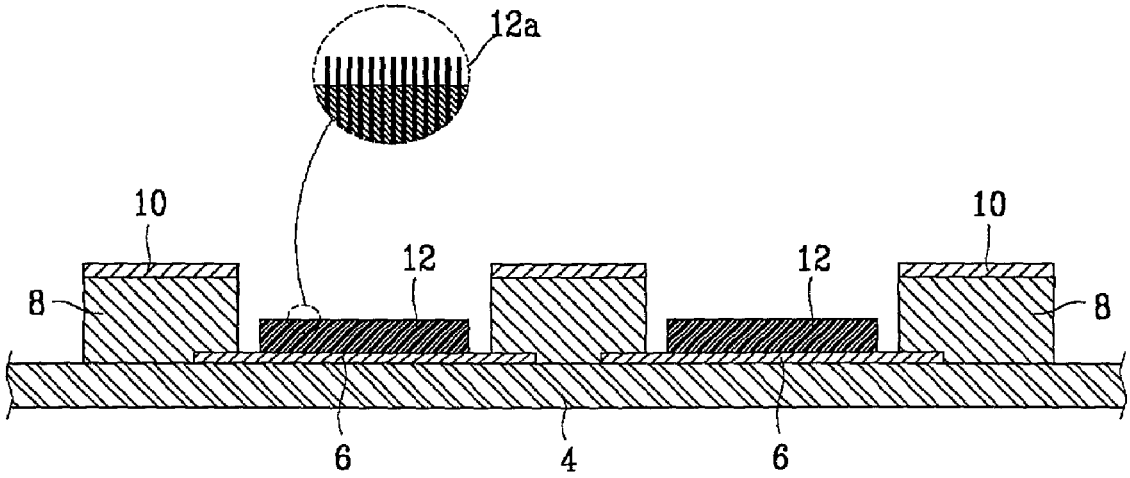

Namely, when the treatment film 20 is detached from the rear substrate 4 by using physical force as shown in FIG. 2*c*, part of the surfaces of the emitters 12 are removed together with the treatment film 20 to define new surfaces of the emitters 12. As a result, front ends of the carbon nanotubes 12*a* are exposed out of the new surfaces of the emitters 20 as shown in FIG. 2*d*.

Figure 3:
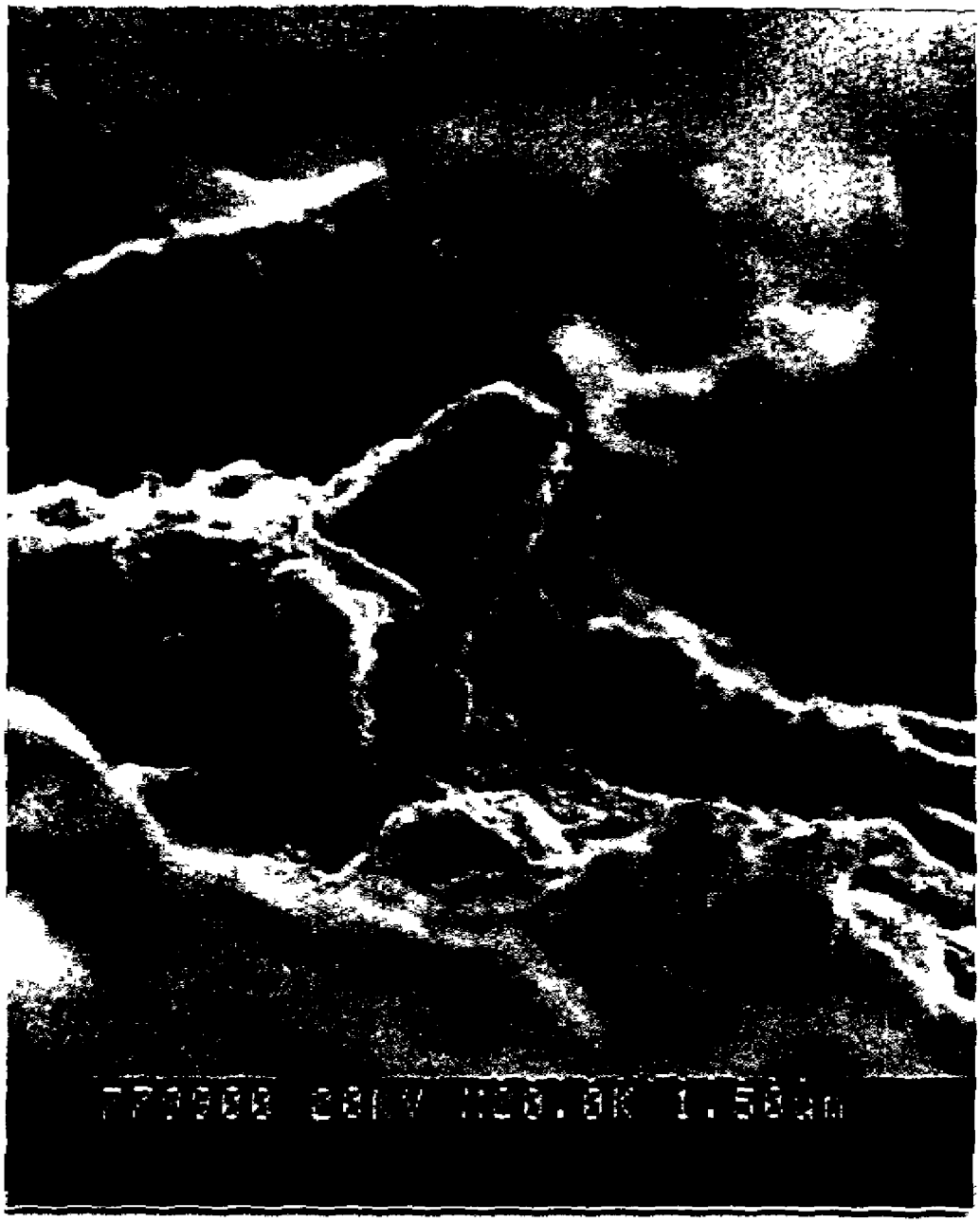
FIG. 3 is a photograph showing a surface of an emitter fabricated under a method of the present invention.
Figure 4:
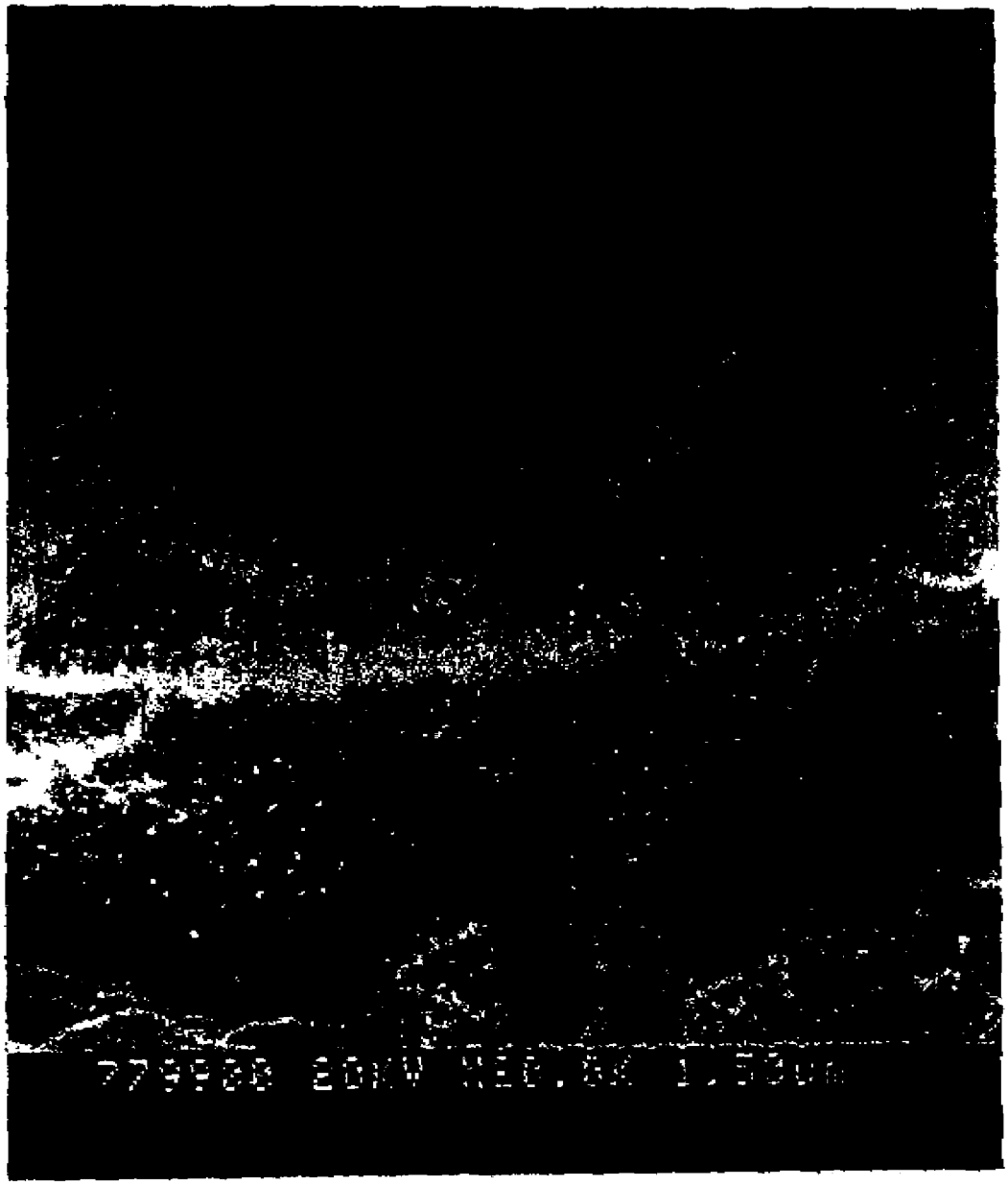
FIG. 4 RELATED ART
FIG. 4 is a photograph showing a surface of an emitter fabricated under a conventional method.

FIG. 3 shows a photograph of an emitter 12 which has gone through the surface treatment process as described above. As shown in the photograph, the front ends of the carbon nanotubes 12*a* are definitely exposed out of the surface of the emitter 12 when compared with a conventional emitter shown in FIG. 4.

Figure 5:
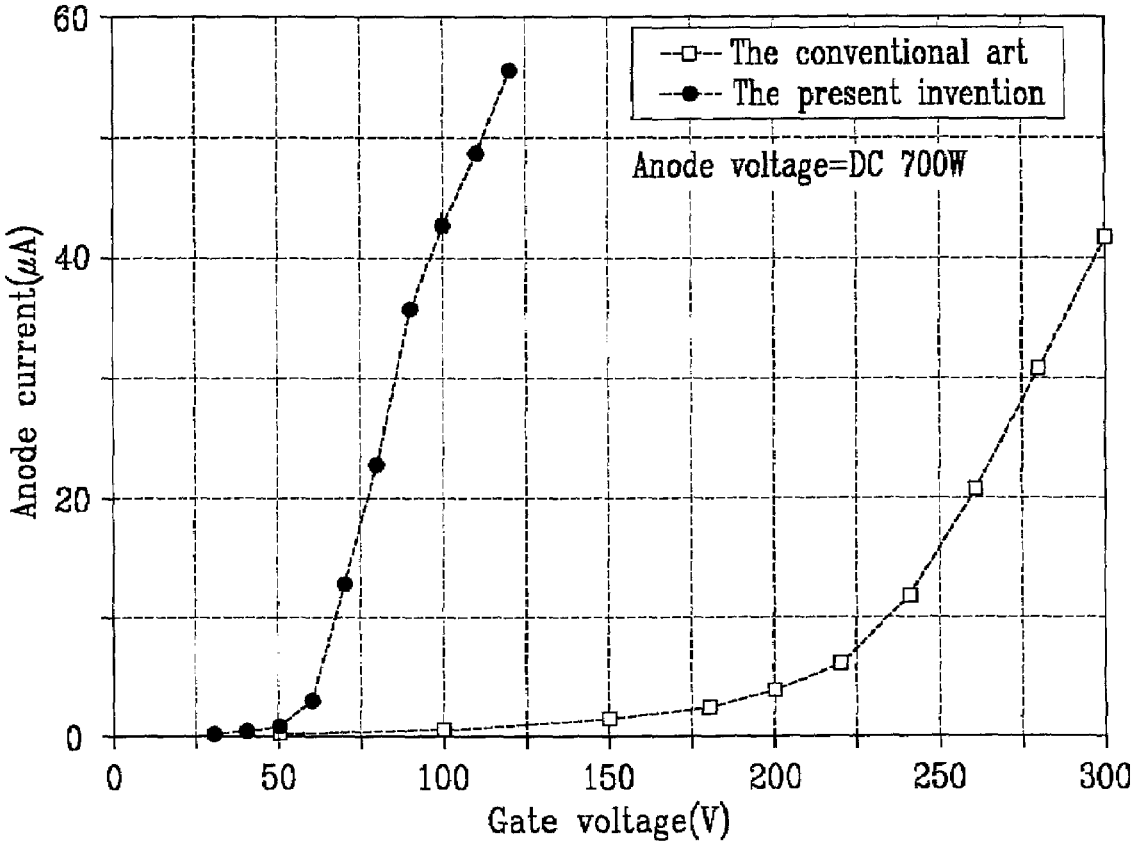
FIG. 5 is a graph illustrating a relationship between a gate voltage and an anode current of a field emission display according to the present invention.

FIG. 5 shows a graph illustrating a relationship between a gate voltage $V_G$ and an anode current ($I_A$) of a field emission display made under the method of the present invention.

As shown in the graph, in the inventive field emission display, a gate voltage of about 100V is required to obtain 40 μA, while in the conventional field emission display, a gate voltage of about 300V is required to obtain 40 μA. This shows that the field emission display made under the present invention can be driven under a relatively low voltage.

While this invention has been described in connection with what is presently considered to be the most practical and preferred embodiments, it is to be understood that the invention is not limited to the disclosed embodiments, but, on the contrary, is intended to cover various modifications and equivalent arrangements included within the spirit and scope of the appended claims.

What is claimed is:

1. A method for fabricating a field emission display, comprising:

forming a cathode electrode on a substrate;

forming an emitter, comprising a carbon-based material, on the cathode electrode;

depositing an emitter surface treatment agent on the substrate to cover the emitter after forming the emitter;

hardening the emitter surface treatment agent; and removing the hardened emitter surface treatment agent from the substrate for exposing the carbon-based material contained in the emitter, wherein the emitter surface treatment agent is hardened by a heat-treatment process.

2. The method of claim 1, wherein the step of forming the emitter further comprises:

printing a paste, comprising the carbon-based material, on the cathode electrode; and heat-treating the printed paste at a temperature lower than a complete-baking temperature for the paste.

3. The method of claim 2, wherein the paste is printed by a screen-printing process using a metal mesh screen.

4. The method of claim 2, wherein the printed paste is heat-treated at the temperature of about 350–430° C. for about 2 minutes.

5. The method of claim 1, wherein the carbon-based material is selected from the group consisting of a carbon nanotube, graphite, and diamond.

6. The method of claim 1, wherein the emitter surface treatment agent is deposited by a spin-coating process.

7. The method of claim 1, wherein the emitter surface treatment agent comprises a polyimide solution.

8. The method of claim 1, wherein the heat-treatment process comprises placing the substrate deposited with the surface treatment agent on a hot plate maintained at a temperature of about 90° C. for about 20 minutes.

9. A method for forming a carbon-based emitter, comprising:

forming an emitter including a carbon-based material;

forming a surface treatment agent over the emitter after forming the emitter;

heating the surface treatment agent for forming a treatment film; and removing at least a portion of the treatment film, wherein the heating of the surface treatment agent is to a temperature of about 90° C.

10. The method of forming a carbon-based emitter of claim 9, wherein the carbon-based emitter is used in a field emission display.

11. The method of forming a carbon-based emitter of claim 9, wherein the surface treatment agent comprises a polymide solution.

12. The method of forming a carbon-based emitter of claim 9, wherein the heating of the surface treatment agent is conducted for about 20 minutes.

13. The method of forming a carbon-based emitter of claim 9, wherein the carbon-based material includes at least one of a carbon-nanotube, graphite, and diamond.

* * * * *